US007024969B2

(12) United States Patent
Smith

(10) Patent No.: US 7,024,969 B2
(45) Date of Patent: Apr. 11, 2006

(54) MODULAR WRENCH WITH EXTENDIBLE SHANK

(76) Inventor: Scott D. Smith, P.O. Box 29, Goose Rock, KY (US) 40964

( * ) Notice: Subject to any disclaimer, the term of this patent is extended or adjusted under 35 U.S.C. 154(b) by 0 days.

(21) Appl. No.: 10/896,004

(22) Filed: Jul. 22, 2004

(65) Prior Publication Data

US 2006/0016297 A1 Jan. 26, 2006

(51) Int. Cl.
*B25B 23/16* (2006.01)
*B25G 1/04* (2006.01)

(52) U.S. Cl. ..... 81/177.2

(58) Field of Classification Search ..... 81/177.1, 81/177.2, 125.1, 489; 403/300
See application file for complete search history.

(56) References Cited

U.S. PATENT DOCUMENTS

| | | | | |
|---|---|---|---|---|
| 1,511,738 | A | 10/1924 | Lownsbery | |
| 2,697,642 | A | 12/1954 | Rudy | |
| 2,964,981 | A | 12/1960 | Blunt | |
| 4,300,607 | A | 11/1981 | Mellinger | |
| 4,409,866 | A * | 10/1983 | McBride | 81/177.2 |
| 4,586,406 | A | 5/1986 | Howard | |
| 5,873,148 | A | 2/1999 | Arnold | |
| 6,336,382 | B1 * | 1/2002 | Cerda | 81/60 |
| 6,378,400 | B1 | 4/2002 | Bogli | |
| 6,408,723 | B1 * | 6/2002 | Zurbuchen | 81/119 |
| D473,768 | S * | 4/2003 | Gilmore | D8/28 |
| 6,691,595 | B1 * | 2/2004 | Hsien | 81/124.5 |
| 2003/0163897 | A1 | 9/2003 | Spinelli | |
| 2003/0204926 | A1 | 11/2003 | Jurgens et al. | |
| 2003/0233718 | A1 | 12/2003 | Heathcock et al. | |
| 2003/0235463 | A1 | 12/2003 | Neumann et al. | |

OTHER PUBLICATIONS

Snap-On Tool Catalog, Snap-On Icorporated, Kenosha, Wisconsin, Jan. 1995, p. 127.

* cited by examiner

*Primary Examiner*—David B. Thomas
(74) *Attorney, Agent, or Firm*—Richard C. Litman

(57) ABSTRACT

The modular wrench with extendible shank includes at least one stubby wrench head segment having either an open end or a box end wrench head, and a truncated shank extending from the wrench head. A short connector sleeve having sockets defined in both ends that frictionally receive the truncated shank of the wrench head segment is provided so that two wrench heads may be attached to opposite ends of the sleeve to form an open end wrench, a box end wrench, or a combination wrench of standard size. Two elongated extension bars, e.g., a six-inch and a ten-inch bar, are provided, each extension bar having a stub projecting from one end that frictionally fits into the connector sleeve, and a socket defined in the opposite end that frictionally receives either the truncated shank of the wrench head or the stub of the other extension bar.

17 Claims, 5 Drawing Sheets

MODULAR WRENCH WITH EXTENDIBLE SHANK

BACKGROUND OF THE INVENTION

1. Field of the Invention

The present invention relates to hand tools, and particularly to a modular wrench with an extendible handle to fit into tight places and to provide increased torque.

2. Description of the Related Art

One of the most commonly used tools in the mechanic's toolbox is the wrench. Wrenches are available in a variety of styles and sizes, the most common being the open end wrench, the box end wrench, and the combination wrench. In many cases a socket wrench can be used to do the same job faster. Nevertheless, the standard flat wrench is still the tool of choice, particularly with the crowded nature of the engine compartment in today's automobile. Quite often the only tool that will fit into tight areas is the standard flat wrench.

However, tools are expensive, and a common problem is that wrenches are needed in a variety of lengths. In restricted spaces, a short, stubby wrench is required, while for other applications a wrench with an elongated shank or handle is required in order to reach the fastener. The mechanic often finds that Murphy's Law applies, and that he doesn't have a wrench of the proper size with a shank or handle long enough to reach the fastener he's working on. While wrenches with extra long shanks may be available through specialty catalogs, they are usually not commonly available at the local hardware or department store. Furthermore, in order to be prepared for any fastener that may be encountered, a multitude of wrenches with shanks of various lengths would have to be purchased.

Consequently, there is a need for a wrench with an extendible shank. Although extendible handles for brooms, mops, and other such pole tools are common, and several devices are available to extend the length of a socket wrench ratchet handle, few efforts have been directed towards extending the reach of a conventional flat wrench.

U.S. Pat. No. 1,511,738, issued Oct. 14, 1924 to F. W. Lownsbery, describes a flat extension handle to extend the reach of a wrench. The wrench is placed against the side of the extension handle and retained by clips extending from opposite sides of the extension handle. A spring-biased stud extends from one edge of the handle to prevent the wrench from rotating free of the clips.

The Snap-On Tools catalog of January 1995 shows heavy-duty/striking wrenches at page 127. The wrenches are available in either open end or box end style, and have a cylindrical shank with a wrench head at one end of the shank. A cylindrical, tubular extension handle can be placed on one end of the shank, and is secured thereto by a locking button. The tubular extension handles are available in lengths between 13½" and thirty-six inches.

Extendible handles for socket wrenches are shown in U.S. Pat. No. 2,964,981, issued Dec. 20, 1960 to O. T. Blunt (foot-operated torque wrench with telescoping arm clamped by thumbscrew); U.S. Pat. No. 4,586,406, issued May 6, 1986 to W. H. Howard (torque wrench with telescoping handle sections secured by detent pins and released by slidable sleeve); and U.S. Pat. No. 6,378,400, issued Apr. 30, 2002 (socket wrench with multiple, inextensible handles and a socket head that can snap onto each handle in turn).

Extendible handles for brooms, mops, and other appliances with pole handles are disclosed in U.S. Patent Publication No. 2003/0163897, published Sep. 4, 2003 (segmented handle with male and female ends that friction fit with a ring over the joint); U.S. Patent Publication No. 2003/0204926, published Nov. 6, 2003 (handle with two segments joined by a link using threaded connection); U.S. Patent Publication No. 2003/0233718, published Dec. 25, 2003 (handle with segments having "ratchets" and "bosses" that twist together to permanently lock segments together); U.S. Patent Publication No. 2003/0235463, published Dec. 25, 2003 (handle with two segments having tabs and recesses that permanently lock segments together when pushed axially); and U.S. Pat. No. 2,697,642, issued Dec. 21, 1954 to J. Rudy (magnetic connector for attaching a broom handle to a broom head, mop head, or the like).

U.S. Pat. No. 4,300,607, issued Nov. 17, 1981 to Mellinger, teaches a variable length tool handle for a screwdriver or the like having upper and lower portions locked together by a detent mechanism. U.S. Pat. No. 5,873,148, issued Feb. 23, 1999 to R. L. Arnold, describes a contoured, segmented grip for a screwdriver or the like having multiple segments axially slidable on a sleeve.

None of the above inventions and patents, taken either singly or in combination, is seen to describe the instant invention as claimed. Thus a modular wrench with an extendible shank solving the aforementioned problems is desired.

SUMMARY OF THE INVENTION

The modular wrench with extendible shank is a segmented wrench with extension bars that can be used to extend the length of the shank. The wrench includes at least one stubby wrench head segment that may have either an open end or a box end wrench head, and a truncated shank extending from the wrench head. A short connector sleeve having sockets defined in both ends that frictionally receive the truncated shank of the wrench head segment is provided so that two wrench heads may be attached to opposite ends of the sleeve to form an open end wrench, a box end wrench, or a combination wrench of standard size. Two elongated extension bars, e.g., a six-inch and a ten-inch bar, are provided, each extension bar having a stub projecting from one end that frictionally fits into the connector sleeve, and a socket defined in the opposite end that frictionally receives either the truncated shank of the wrench head or the stub of the other extension bar.

In use, the stubby wrench head segment may be used by itself or with only the connector sleeve attached when a very short wrench is needed to fit into tight quarters. Two open head wrench heads or two box end wrench heads of different sizes may be attached to opposite ends of the sleeve to form a standard size open end or box end wrench, respectively, or an open end and a box end wrench head of the same size may be attached to opposite ends of the connector sleeve to form a standard size combination wrench. When additional length is needed to reach a fastener or to apply additional torque, an extension bar may be attached to the sleeve, and a second extension bar may be chained together to the first, if necessary. The wrench heads may be SAE or metric, and the box end wrench heads may be straight or offset. A kit may be supplied with a single connector sleeve, a single extension bar each of one or more lengths, and a plurality of open end and box end wrench heads to provide the mechanic with an appropriate selection of wrenches for various fasteners that may be encountered.

Accordingly, it is a principal object of the invention to provide a modular wrench with an extendible shank for reaching into tight places.

It is another object of the invention to provide a modular wrench with an extendible shank for applying additional torque to a fastener.

It is a further object of the invention to provide a modular wrench with an extendible shank that reduces or eliminates the need for purchasing multiple wrenches having shanks of different lengths.

Still another object of the invention is to provide a modular wrench kit for enabling a mechanic to form open end, box end, and combination end wrenches of various lengths to reach fasteners in tight locations.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
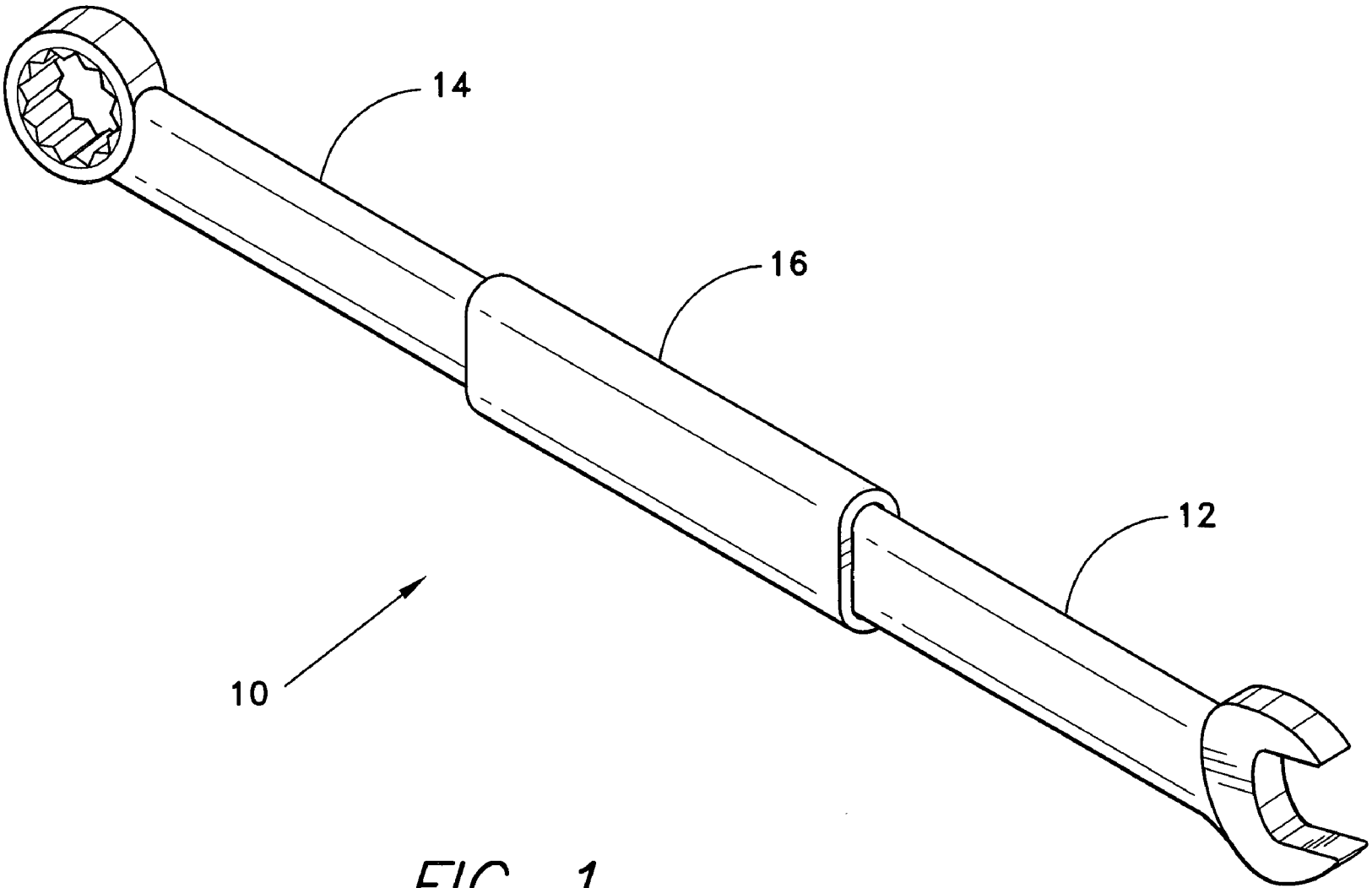
FIG. 1 is a perspective view of a modular wrench with extendible shank according to the present invention configured as a combination wrench.

The present invention is a modular wrench with an extendible shank, designated generally as 10 in the drawings. FIG. 1 shows the modular wrench 10 configured as a combination wrench, including an open end wrench head segment 12, a box end wrench head segment 14, and a connector sleeve 16 joining the two wrench head segments 12 and 14.

Figure 2:
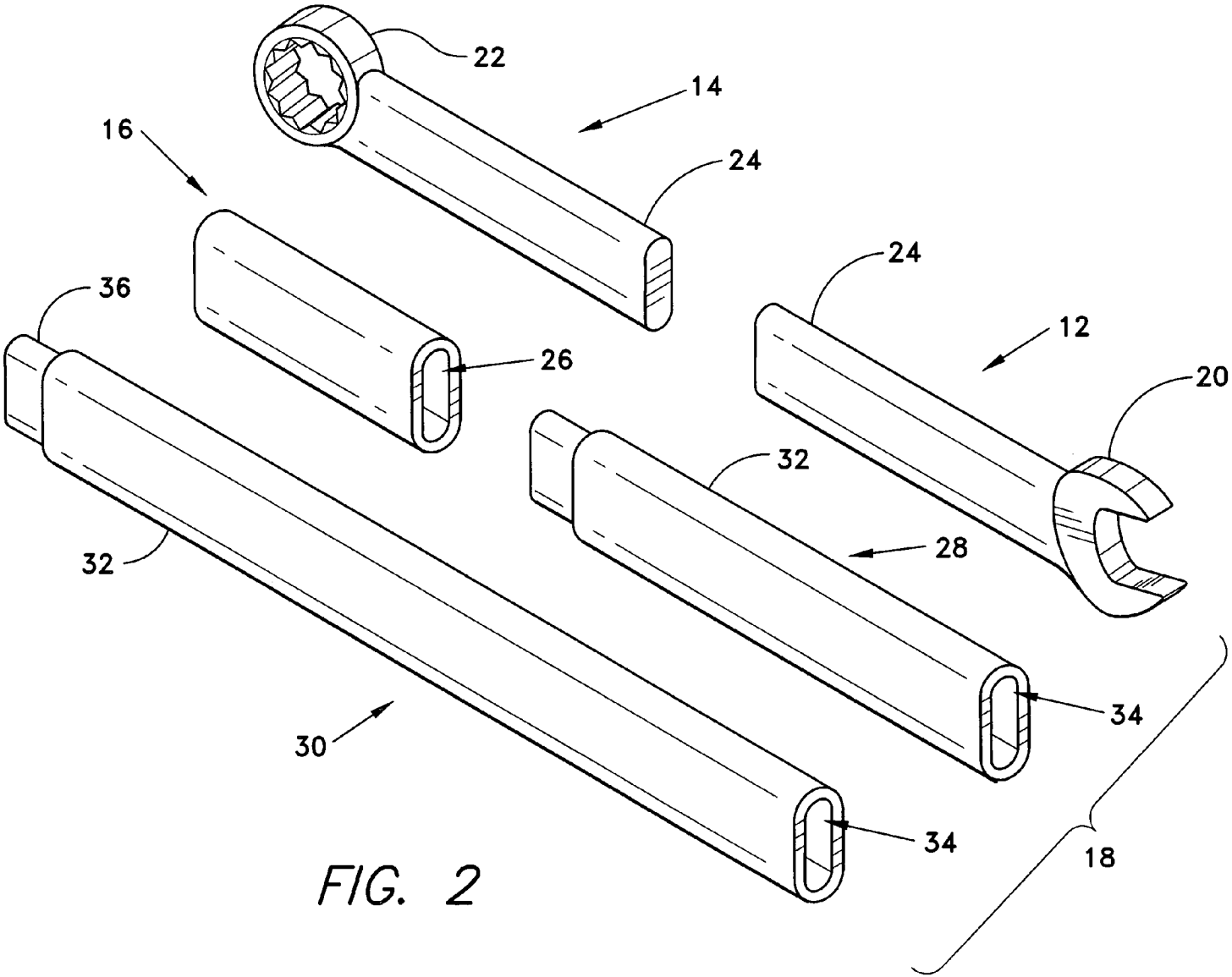
FIG. 2 is a perspective view of a modular wrench kit according to the present invention.
Figure 3:
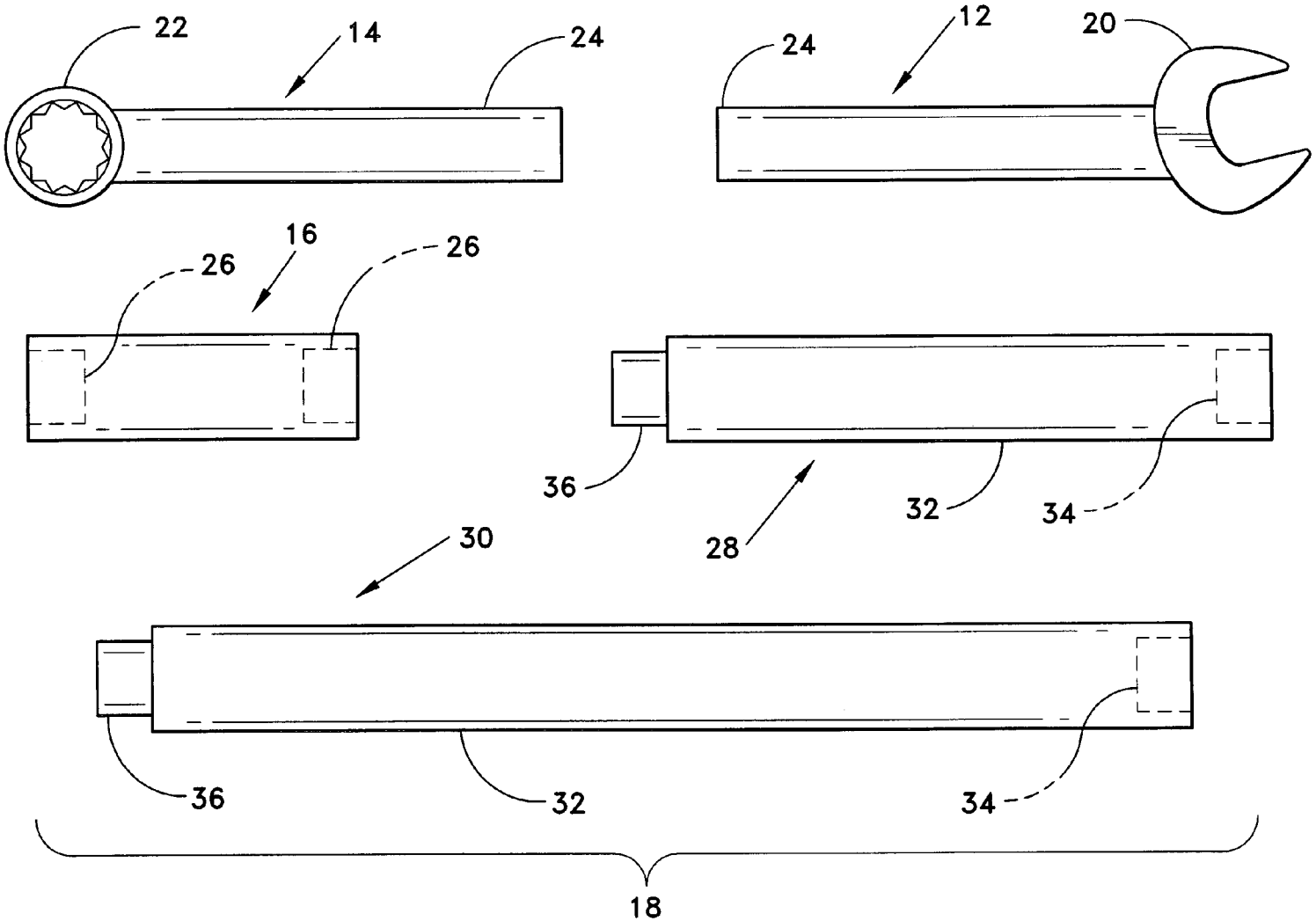
FIG. 3 is a plan view of a modular wrench kit according to the present invention.

FIGS. 2 and 3 show the components of a typical modular wrench kit 18. The kit 18 includes at least one, and preferably a plurality of, short or stubby wrench head segments. FIGS. 2 and 3 show the kit 18 containing an open end wrench head segment 12 and a box end wrench head segment 14, although it will be understood that the modular wrench 10 may have two open end wrench head segments 12 of different sizes with a connector sleeve 16 to form an open end wrench, or two box end wrench head segments 14 of different sizes with a connector sleeve 16 to form a box end wrench. Although the drawings show a kit 18 containing only two wrench head segments 12 and 14 for forming a single wrench, it will be obvious that the kit may be furnished with a plurality of open end wrench head segments 12 and/or a plurality of box end wrench head segments 14 so that the mechanic may form whatever wrench or combination wrench that may be required for the job at hand.

Each wrench head segment 12 and 14 includes either an open end wrench head 20, a box end wrench head 22, or any other type of wrench head (e.g., a pivotally mounted socket as included in flex-head wrenches, ratcheting box end, etc.) that may be mounted on a flat shank, and a truncated shank 24 so that the wrench head segment forms a short or stubby wrench head segment. Although the length of the truncated shank 24 will vary with the size of the wrench head, a representative dimension of the truncated shank may be, e.g., about four inches. The box end wrench head 22 may be a six-point, twelve-point, or other desired box end suited for gripping a fastener. The box end wrench head segment 14 may be either a straight segment or an offset segment. The open end wrench head segment 12 may have a conventional 15° angle wrench head 20, or an open end jaw angled to any desired degree.

The connector sleeve 16 is a short bar having sockets 26 formed in opposite ends of the bar. The sockets 26 are dimensioned and configured to receive the end of the truncated shank 24 of either of the wrench head segments 12 or 14. The truncated end of the shank 24 slides into the socket 26 and is maintained by friction. The connector sleeve 16 is generally shorter in length than the truncated shank 24, three inches being a representative dimension. The socket 26 has a depth sufficient to maintain the truncated shank 24 when leverage is applied to the modular wrench 10, about one-half inch being representative.

The kit 18 also includes at least one extension bar for extending the length of the shank of the modular wrench 10. FIGS. 2 and 3 show a short extension bar 28 and a long extension bar 30. In practice, the kit 18 may contain only a single extension bar, or more than two extension bars, each having a different length. Each extension bar 28 and 30 has an elongated shank 32, a socket 34 defined in one end of the shank 32, and a stub 36 extending from the opposite end of the shank 32. The socket 34 is generally equal in dimension to the socket 26 formed in the opposing ends of the connector sleeve 16, having the same length, width, depth, and shape. The stubs 36 form a male connector of complementary size and shape to the female sockets 26 and 34 in order to slide into the sockets 26 and 34, frictionally engage the walls of the sockets 26 and 34, and to withstand any shear force applied to the stubs 36 when leverage is applied to the modular wrench 10 for tightening or loosening a fastener.

Although the stubs 36 and the sockets 26 and 34 are shown in the drawings as having a flattened oval shape, or a rectangular shape with arcuate ends, it will be understood the stubs 36 and sockets 26 and 34 may have any desired shape. A cylindrical shape is not recommended, however, as rotation of the segments of the modular wrench may occur unless the cylinder is keyed or otherwise modified. The stubs 36 and sockets 26 and 34 may have a shape identical or corresponding to the cross-sectional shape of the truncated shank 24 of the wrench head segments 12 and 14. The short extension bar 28 and the long extension bar 30 may have any convenient length, six inches and ten inches, respectively, being representative dimensions.

The various components of the kit 18 are preferably made from steel or a steel alloy, such as vanadium steel, or any other material conventionally used for making wrenches, and may be chrome-plated. The wrench head segments 12 and 14 may be furnished in SAE or metric sizes, or both.

Figure 4:
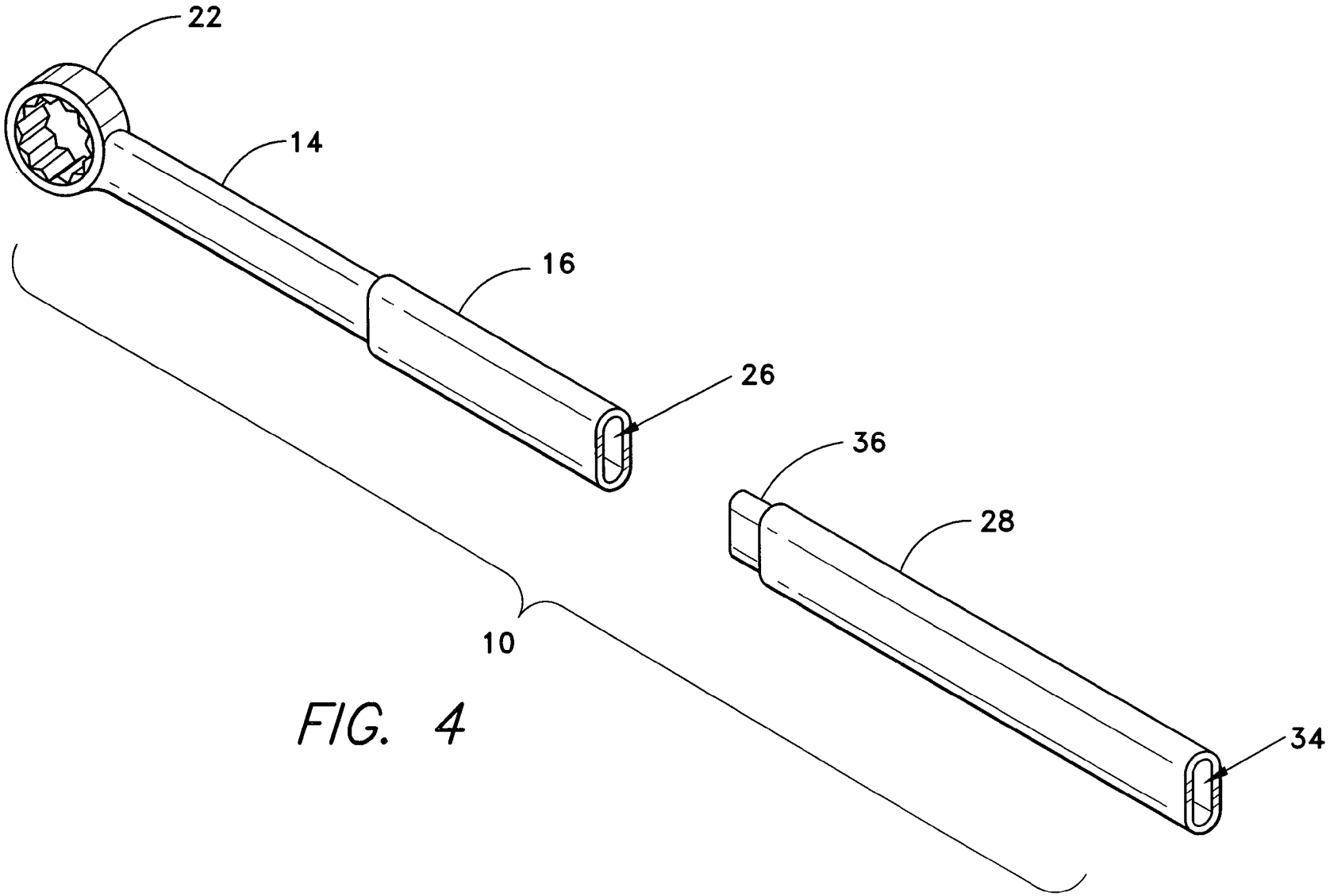
FIG. 4 is a partially exploded perspective view of a modular wrench according to the present invention, showing insertion of an extension bar into the sleeve.

FIG. 4 shows the modular wrench 10 fitted with an extension bar to extend the length of the shank. The wrench includes a box end wrench head segment 14 fitted with a connector sleeve 16, the stub 36 of a short extension bar 28 being slidably inserted into the socket 26 at the free end of the connector sleeve 16. The modular wrench 10 can then be used as is, or the open end wrench head segment 12 can be inserted into the socket 34 of the extension bar 28 to form a combination wrench and extend the length of the shank by a further three and one-half inches, or the stub 36 end of the long extension bar 30 can be inserted into the socket 34 of the short extension bar 28 to further extend the length of the shank by 9.5–10".

Figure 5:
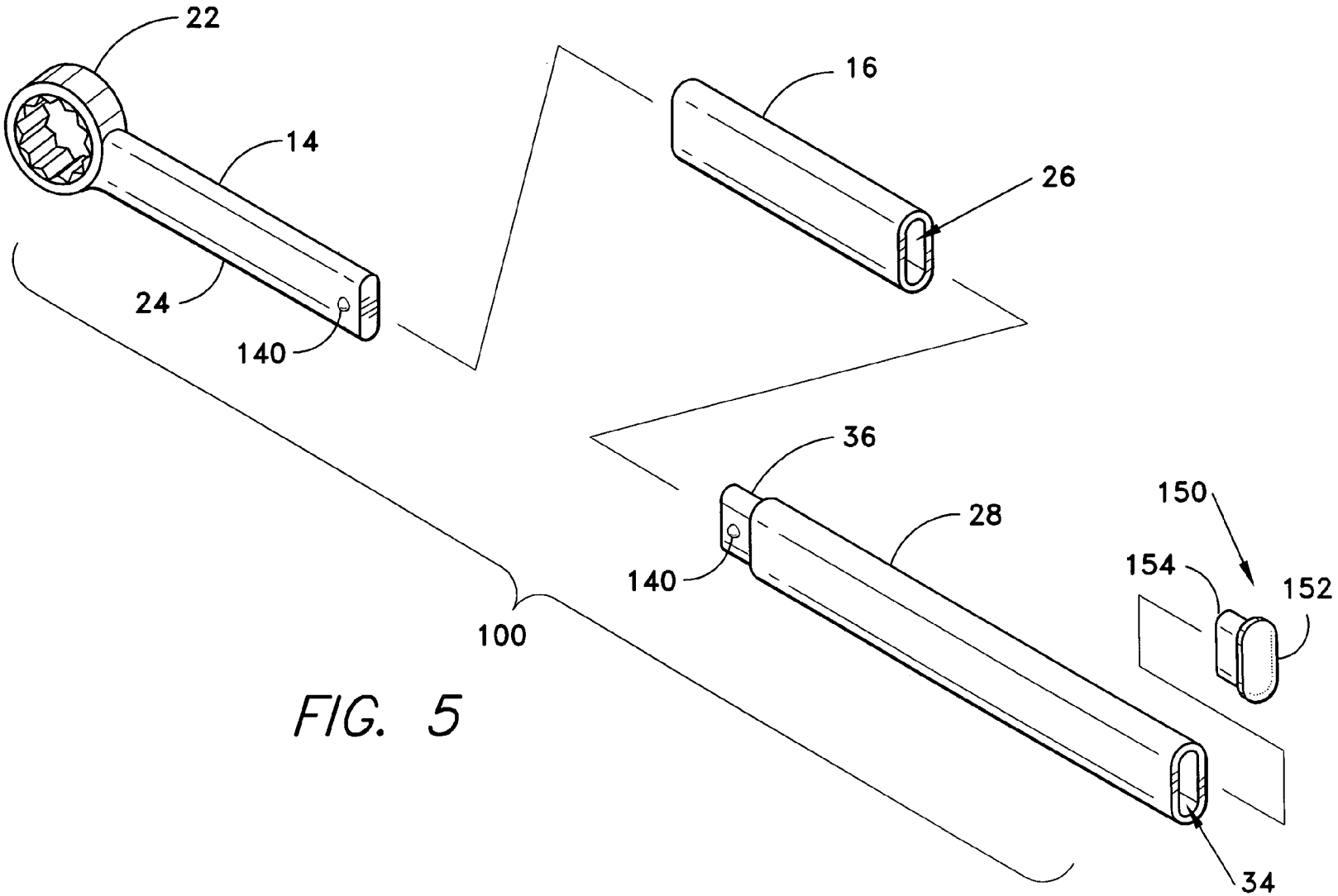
FIG. 5 is an exploded perspective view of an alternative embodiment of a modular wrench according to the present invention.

FIG. 5 shows an alternative embodiment of a modular wrench according to the present invention, designated as 100. In this embodiment, a spring-biased detent ball 140 may be built into the end of the truncated shank 24 of the open end wrench head segment 12, the box end wrench head segment 14 (only the box end segment 14 being shown in FIG. 5, the open end segment 12 being similar), and the stub 36 at the end of the extension bars 28 and 30 on one or both sides of the shank 24 and stub 36, respectively, in order to provide positive means for frictionally engaging the walls of the sockets 26 and 34, in a manner similar to the retention of sockets on the drive of a socket wrench ratchet. Such spring-biased detent balls 140 are well known in the tool-making art, so that further construction detail will be omitted.

In addition, the modular wrench 100 and wrench kit 18 may optionally include an end cap 150 that snaps into either the socket 26 at the end of the connector sleeve 16 or the socket 34 at the end of the extension bars 28 and 30 so that the modular wrench 10 and 100 is used with a single wrench head segment 12 or 14. In this case the connector sleeve 16 or one of the extension bars 28 and 30 serves as a grip or handle. The end cap 150 has a flat, planar pad 152 dimensioned and configured for covering the end of the sockets 26 and 34, and a stub or projection 154 dimensioned and configured for frictionally gripping the interior walls of the socket 26 and 34. The end cap 150 may be made from plastic, rubber, or other suitable material.

In use, either wrench head segment 12 or 14 may be used by itself to reach fasteners in places where a long shank wrench will not fit and a short or stubby wrench is required. By adding the connector sleeve 16 and a second wrench head segment, a standard length open end, box end, or combination wrench may be formed. When additional length is needed to reach a fastener or to apply more torque, an extension bar 28 or 30 can be inserted into the connector sleeve 16 to extend the length of the shank, as required. Consequently, the modular wrench 10 and wrench kit 18 forms an economical, versatile, easy to use addition to the mechanic's toolbox.

It is to be understood that the present invention is not limited to the embodiments described above, but encompasses any and all embodiments within the scope of the following claims.

I claim:

1. A modular wrench with extendible shank, comprising:

(a) a first wrench head segment having a wrench head and a truncated shank extending from the wrench head, the truncated shank having a truncated end;

(b) a connector sleeve, the sleeve being an elongated bar having opposing ends, each of the opposing ends having a socket defined therein, the truncated end of the wrench head segment being slidable into and engaging the socket in order to extend the length of the shank; and (c) at least one elongated extension bar having an elongated shank, a first end having a socket defined therein, and an opposing second end having a stub extending therefrom, the stub being slidably inserted into and engaging one of the sockets defined in said connector sleeve in order to extend the length of the wrench.

2. The modular wrench with extendible shank according to claim 1, further comprising a second wrench head segment having a wrench head and a truncated shank extending from the wrench end, the truncated shank having a truncated end, the first and second wrench head segments being slidably inserted into and engaging the sockets in the opposing ends of said connector sleeve.

3. The modular wrench with extendible shank according to claim 2, wherein the wrench head of said first wrench head segment and the wrench head of said second wrench head segment both comprise an open end wrench head.

4. The modular wrench with extendible shank according to claim 2, wherein the wrench head of said first wrench head segment and the wrench head of said second wrench head segment both comprise a box end wrench head.

5. The modular wrench with extendible shank according to claim 2, wherein the wrench head of said first wrench head segment comprises an open end wrench head and the wrench head of said second wrench head segment comprises a box end wrench head.

6. The modular wrench with extendible shank according to claim 1, wherein said at least one elongated extension bar comprises a first extension bar and a second extension bar having different lengths, the stub of each one of the extension bars being insertable into the socket defined in the connector sleeve and the socket defined in the other extension bar, so that the wrench is extendible in length by attachment of one or both of the extension bars in succession to said connector sleeve.

7. The modular wrench with extendible shank according to claim 1, wherein said at least one elongated extension bar comprises a first extension bar and a second extension bar having different lengths, the stub of each one of the extension bars being insertable into the socket defined in the connector sleeve and the socket defined in the other extension bar, so that the wrench is extendible in length by attachment of one or both of the extension bars in succession to said connector sleeve.

8. The modular wrench with extendible shank according to claim 1, further comprising a spring-biased detent ball disposed in the truncated end of said wrench head segment and in the stub projecting from said extension bar for engaging the sockets defined in said connector sleeve.

9. The modular wrench with extendible shank according to claim 1, wherein the truncated end of the shank of said wrench head segment and the sockets defined in the opposing ends of said connector sleeve each have a flattened oval shape in cross section.

10. The modular wrench with extendible shank according to claim 1, wherein the sockets defined in the opposing ends of said connector sleeve each have a depth of about one-half inch.

11. The modular wrench with extendible shank according to claim 10, wherein the sockets defined in the opposing ends of said connector sleeve each have a flattened oval shape in cross section.

12. The modular wrench with extendible shank according to claim 1, further comprising an end cap having a planar pad and a stub projecting from the pad, the stub being removably inserted in one of the sockets defined in said connector sleeve so that the pad covers the socket.

13. A modular wrench kit, comprising:

(a) a first wrench head segment and a second wrench head segment, each of the segments having a wrench head and a truncated shank extending from the wrench head, the truncated shank having a truncated end;

(b) a connector sleeve, the sleeve being an elongated bar having opposing ends, each of the opposing ends having a socket defined therein;

(c) at least one elongated extension bar having an elongated shank, a first end having a socket defined therein, and an opposing second end having a stub extending therefrom, the socket defined in the extension bar being substantially equal in dimension and shape to the sockets defined in the connector sleeve; and (d) an end cap having a planar pad and a stub protecting from the pad, the stub being removably inserted in one of the sockets defined in said connector sleeve so that the pad covers the socket;

wherein the truncated end of the first and second wrench head segments, the stub extending from the pad, and the stub extending from the elongated extension bar are interchangeably inserted into and engage the sockets defined in the connector sleeve; and wherein the truncated end of the first and second wrench head segments, and the stub extending from the pad are interchangeably inserted into and engage the sockets defined in the connector sleeve and the extension bar, whereby the first and second wrench head segments, the connector sleeve, and the extension bar are attachable in a user selectable combination to form a wrench with extendible shank length, and the pad selectively closes an open socket.

14. The modular wrench kit according to claim 13, wherein the wrench head of said first wrench head segment and the wrench head of said second wrench head segment both comprise an open end wrench head.

15. The modular wrench kit according to claim 13, wherein the wrench head of said first wrench head segment and the wrench head of said second wrench head segment both comprise a box end wrench head.

16. The modular wrench kit according to claim 13, wherein the wrench head of said first wrench head segment comprises an open end wrench head and the wrench head of said second wrench head segment comprises a box end wrench head.

17. The modular wrench kit according to claim 13, wherein said at least one elongated extension bar comprises a first extension bar and a second extension bar having different lengths, the stub of each one of the extension bars being insertable into the socket defined in the connector sleeve and the socket defined in the other extension bar, so that the wrench is extendible in length by attachment of one or both of the extension bars in succession to said connector sleeve.

* * * * *